US007101015B2

(12) United States Patent
Jun

(10) Patent No.: US 7,101,015 B2
(45) Date of Patent: Sep. 5, 2006

(54) PRINT CONTROL APPARATUS AND METHOD FOR INKJET PRINTERS CAPABLE OF PREVENTING PRINT QUALITY DETERIORATION DUE TO PRINT POSITION ERRORS DURING BI-DIRECTIONAL OPERATIONS

(75) Inventor: Jin-Hwi Jun, Suwon (KR)

(73) Assignee: Samsung Electronics, Co., Ltd., (KR)

( * ) Notice: Subject to any disclaimer, the term of this patent is extended or adjusted under 35 U.S.C. 154(b) by 216 days.

(21) Appl. No.: 10/757,495

(22) Filed: Jan. 15, 2004

(65) Prior Publication Data

US 2004/0263552 A1 Dec. 30, 2004

(30) Foreign Application Priority Data

Jun. 25, 2003 (KR) ..... 10-2003-0041528

(51) Int. Cl.
*B41J 29/393* (2006.01)
*B41J 23/00* (2006.01)

(52) U.S. Cl. ..... 347/19; 347/37

(58) Field of Classification Search ..... 347/19, 347/37

See application file for complete search history.

(56) References Cited

U.S. PATENT DOCUMENTS 5,331,680 A * 7/1994 Ueno ..... 347/37

FOREIGN PATENT DOCUMENTS

JP 04-268407 9/1992
KR 1990-0003228 4/1990

* cited by examiner

*Primary Examiner*—Stephen Meier
*Assistant Examiner*—Julian D. Huffman
(74) *Attorney, Agent, or Firm*—Roylance, Abrams, Berdo & Goodman LLP

(57) ABSTRACT

A print control apparatus and method for inkjet printers. The print control apparatus includes an encoder sensor for outputting a first and a second signal every time a slit is detected; a direction decision unit for determining a travel direction of a carriage having a printer head therein based on the first and the second signal output from the encoder sensor; and an edge detection unit for detecting rising and falling edges of the first and second signals. The apparatus further includes a position counter for increasing and decreasing a counting value in relation to the direction decision signal and the edge detection signal; and a control unit for moving the carriage to a predetermined reference position if the value counted by the position counter is equal to a predetermined reference position value, and outputting a print reference signal to the printer head, wherein the control unit outputs the print reference signal based on the same edge detected by the edge detection unit regardless of the travel direction of the carriage.

10 Claims, 6 Drawing Sheets

PRINT CONTROL APPARATUS AND METHOD FOR INKJET PRINTERS CAPABLE OF PREVENTING PRINT QUALITY DETERIORATION DUE TO PRINT POSITION ERRORS DURING BI-DIRECTIONAL OPERATIONS

CROSS-REFERENCE TO RELATED APPLICATIONS

This application claims the benefit of Korean Patent Application No. 2003-41528, dated Jun. 25, 2003, in the Korean Intellectual Property Office, the disclosure of which is incorporated herein by reference.

BACKGROUND OF THE INVENTION

1. Field of the Invention

The present invention relates to an inkjet printer having a bi-directional print function, and more particularly, to a print control apparatus and a method for inkjet printers capable of preventing print quality deterioration due to print position errors when bi-directional print operations are performed.

2. Description of the Related Art

Typically, inkjet printers use a micro injecting device with an ink cartridge. The micro injecting device is used often due to its color print implementation, less noise, and gorgeous print quality. The inkjet printers fire ink through nozzles of the micro injecting device to perform print jobs and are provided with an encoder sensor to sense the location of a carriage mounted in the micro injecting device as well as to control the speed of the carriage via a print control signal.

FIG. 1 is a block diagram illustrating an example of a print control apparatus for a conventional inkjet printer.

Referring to FIG. 1, a print control apparatus has an encoder strip 10, an encoder sensor 20, a position counter 30, a register 40, a comparator 50, and a controller 60.

The encoder strip 10 has slits spaced in certain intervals and formed on one side thereof.

The encoder sensor 20 is disposed in proximity to the encoder strip 10, and outputs a pulse signal according to the slits formed on the encoder strip 10. That is, the encoder sensor 20 emits light onto the encoder strip 10, receives light passing through the encoder strip 10, and outputs two-phase signals CHX and CHY. The two-phase signals CHX and CHY are used to control the travel direction and speed of the carriage return motor.

The position counter 30 increases or decreases a certain counting value in relation to the level changes of the two-phase signals CHX and CHY output from the encoder sensor 20.

The comparator 50 compares a position value counted by the position counter 30 and a reference position value pre-stored in the register 40, and outputs a comparison result signal to the controller 60.

If the position value counted by the position counter 30 is determined to be identical to the reference position value pre-stored in the register 40 as a result of the comparison of the comparator 50, the controller 60 recognizes that the carriage is trying to get to a print start position. If the carriage is determined to be trying to get to the print start position, the controller 60 generates a print reference signal based on the rising edge or the falling edge of a reference signal, such as a signal CHX, of the two-phase signals CHX and CHY output from the encoder sensor 20, and outputs the print reference signal to a printer head (not shown). The print reference signal indicates a signal having all the nozzles of the printer head fired.

Descriptions will be made, for example, where a print reference signal is generated based on the rising edge of a first signal CHX which becomes a reference signal of the two-phase signals CHX and CHY output from the encoder sensor 20.

When the carriage is determined to be traveling from left to right or from right to left, the controller 60 generates a print reference signal based on the rising edge of the first signal CHX output from the encoder sensor 20.

As mentioned above, in case the controller 60 generates the print reference signal based on the rising edge of the first signal CHX output from the encoder sensor 20 regardless of the travel direction of the carriage, as shown in FIG. 2, a problem occurs where the print start positions are not aligned due to print position errors.

In FIG. 2, a reference numeral 'A' denotes print positions where, when the carriage travels from left to right, the controller 60 performs a print job based on the rising edge of the first signal CHX output from the encoder sensor 20, and a reference numeral 'B' denotes print positions where one period of the first signal CHX is divided into a half thereof.

A reference numeral 'A' denotes print positions where, when the carriage travels from right to left, the controller 60 performs a print job based on the rising edge of the first signal CHX output from the encoder sensor 20, and a reference numeral 'B" denotes print positions where one period of the first signal CHX is divided into a half thereof.

As shown in FIG. 2, if a print job is performed with reference to the positions A and A', it is possible to print with a higher resolution than a resolution of the encoder strip 10, and, if a print job is performed with reference to the positions B and B', it is possible to print with a higher resolution than a resolution of the encoder strip 10. As such, if a print job is performed with a one-period signal of the encoder sensor 20 being divided into a certain period, high resolution printing becomes possible with the encoder strip 10 of low resolution. Furthermore, in case a bi-directional print job is performed, high resolution printing becomes possible.

However, if the print reference signal is output based on a different edge when the bi-directional print job is performed as in the prior art, an error occurs during a certain interval C, as shown in FIG. 2, at print positions due to the tolerance of slits formed on the encoder strip 10. Accordingly, a problem occurs that deteriorates the print quality since print start positions are not aligned.

SUMMARY OF THE INVENTION

Accordingly, it is an aspect of the present invention to provide a print control apparatus and method for inkjet printers capable of removing print start position alignment errors occurring when bi-directional print operations for high resolution printing is performed, to thereby enhance print quality.

In order to achieve the above aspect, a print control apparatus for inkjet printers according to the embodiment of the present invention comprises an encoder sensor for outputting a first and a second signal every time a slit is detected; a direction decision unit for deciding a travel direction of a carriage having a printer head therein based on the first and the second signal output from the encoder sensor; an edge detection unit for detecting rising and falling edges of the first and second signals; a position counter for increasing and decreasing a counting value in relation to the direction decision signal and the edge detection signal; and a control unit for moving the carriage to a predetermined reference position if the value counted by the position counter is equal to a predetermined reference position value, and outputting a print reference signal to the printer head, wherein the control unit outputs the print reference signal based on the same edge detected by the edge detection unit regardless of the travel direction of the carriage.

Preferably, the print control apparatus further comprises a comparator for comparing the value counted by the position counter and the reference position value; and a pulse generator for generating a pulse corresponding to the print reference signal according to controls of the control unit.

The position counter increases the counting value if the carriage is determined to be traveling from the first position to the second position as a result of the decision of the direction decision unit, and decreases the counting value if the carriage is determined to be traveling from the second position to the first position.

In case the print reference signal is output based on the rising edge of the first signal detected by the edge detection unit when the carriage travels from the first position to the second position, the control unit controls the pulse generator to output the print reference signal based on the falling edge of the first signal when the carriage travels from the second position to the first position.

If the print reference signal is output based on the falling edge of the first signal detected by the edge detection unit when the carriage travels from the first position to the second position, the control unit controls the pulse generator to output the print reference signal based on the rising edge of the first signal when the carriage travels from the second position to the first position.

In the meantime, in order to achieve the above aspect, a control method for a print control apparatus according to the embodiment of the present invention comprises steps of detecting rising and falling edges of first and second signals output from an encoder sensor every time a slit formed on an encoder strip is detected; determining a travel direction of a carriage having a printer head therein based on the first and the second signal output from the encoder sensor; increasing and decreasing a counting value based on an edge detection signal and a signal indicating a travel direction of the carriage; comparing the counted value and a predetermined reference position value; and moving the carriage to a predetermined reference position if the counted value is equal to the predetermined reference position value, and outputting a print reference signal to the printer head, wherein the print reference signal is output based on the same edge detected by the edge detection step regardless of the travel direction of the carriage.

The counting step comprises steps of increasing the counting value if the carriage is determined to be traveling from a first position to a second position; and decreasing the counting value if the carriage is determined to be traveling from the second position to the first position.

BRIEF DESCRIPTION OF THE DRAWINGS

The invention will be described in detail with reference to the following drawings in which like reference numerals refer to like elements, and wherein.

DETAILED DESCRIPTION OF THE PREFERRED EMBODIMENTS

Hereinafter, the present invention will be described with reference to the attached drawings.

Figure 1:
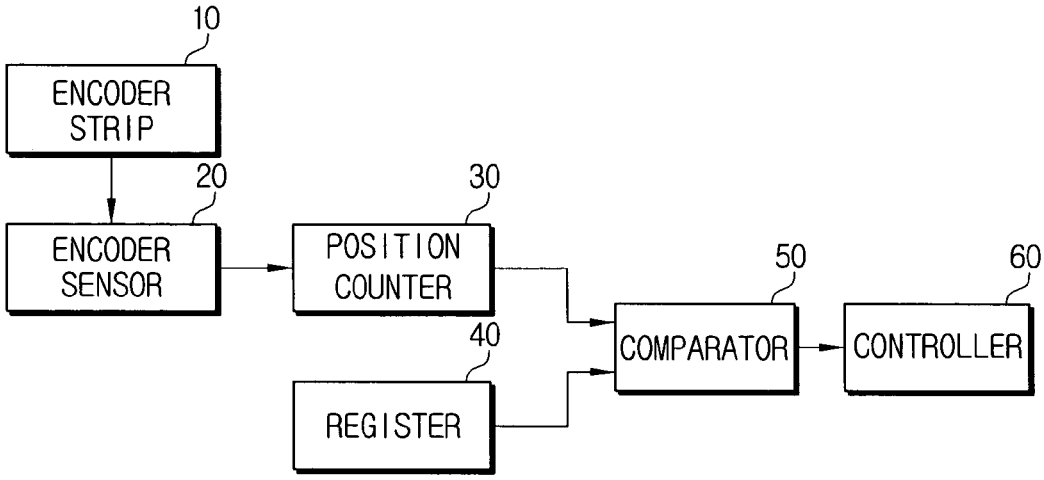
FIG. 1 (PRIOR ART)
FIG. 1 is a block diagram illustrating an example of a print control apparatus for conventional inkjet printers.
Figure 2:
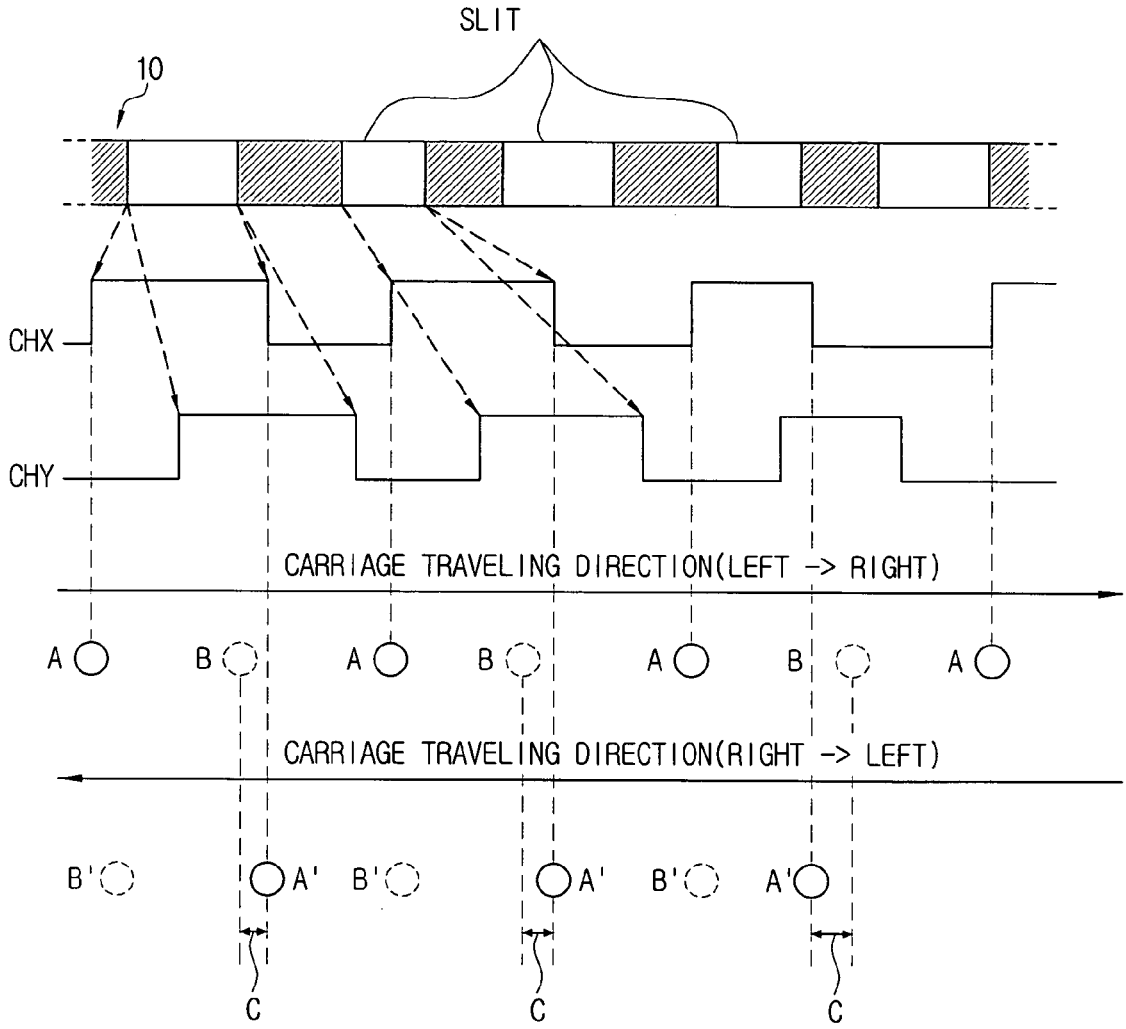
FIG. 2 (PRIOR ART)
FIG. 2 is a diagram illustrating an example of print positions when bi-directional print operations are performed using the print control apparatus shown in FIG. 1.
Figure 3:
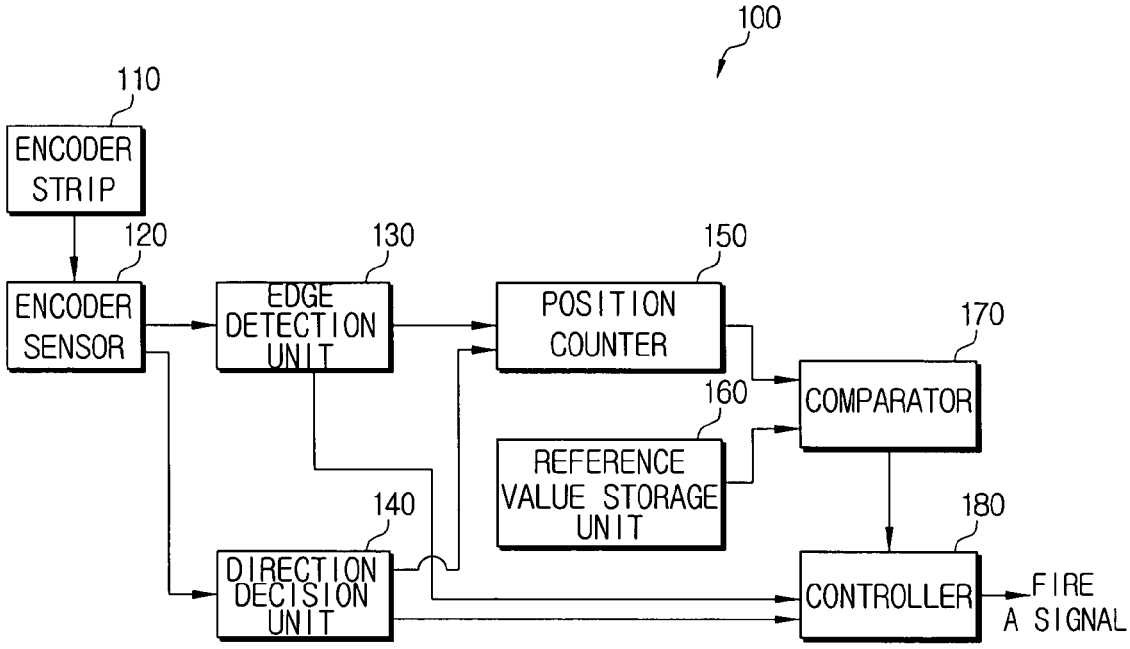
FIG. 3 is a block diagram illustrating an example of a print control apparatus for inkjet printers having a bi-directional print function according to an embodiment of the present invention.

FIG. 3 is a block diagram illustrating an example of a print control apparatus for a bi-directional inkjet printer according to an embodiment of the present invention.

Referring to FIG. 3, a print control apparatus 100 has an encoder strip 110, an encoder sensor 120, an edge detection unit 130, a direction decision unit 140, a position counter 150, a reference value storage unit 160, a comparator 170, and a controller 180.

The encoder strip 110 has slits spaced in a certain interval and formed on one side thereof.

Figure 4A:
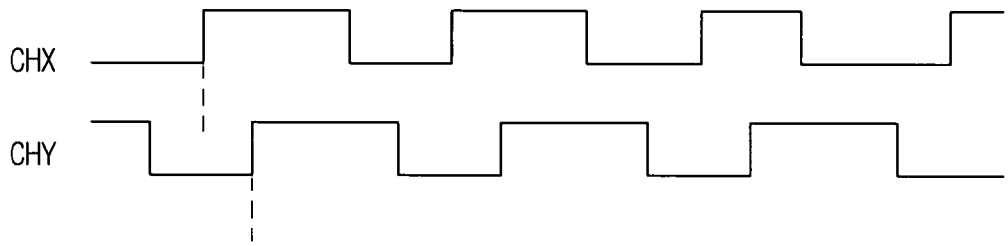
FIG. 4*a* and FIG. 4*b* are diagrams illustrating examples of output signals of an encoder sensor shown in FIG. 3.
Figure 4B:
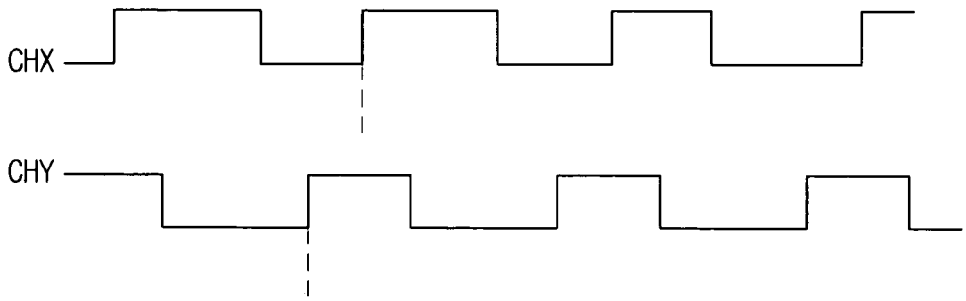

The encoder sensor 120 is disposed on one side of a carriage in which the printer head is mounted at a position corresponding to the encoder strip 110, emits light onto the encoder strip 110 to detect a position of the carriage, receives light passing through the slits, and outputs a signal. That is, the encoder sensor 120 detects slits formed on the encoder strip 10 in relation to the movements of the carriage, and outputs the two-phase signals CHX and CHY whenever a slit is detected. The two-phase signals CHX and CHY have the same period and a phase difference of 90°. Further, when the carriage moves from left to right, that is, from a first position to a second position, as shown in FIG. 4*a*, the phase of the first signal CHX is set to precede the phase of the second signal CHY, and, when the carriage travels from right to left, as shown in FIG. 4*b*, the phase of the second signal CHY is set to precede the phase of the first signal CHX. The two-phase signals CHX and CHY output from the encoder sensor 120 are output to the edge detection unit 130 and the direction decision unit 140.

The direction decision unit 140 determines movement direction of the carriage based on the two-phase signals CHX and CHY output from the encoder sensor 120, and outputs a direction decision signal to the controller 180. If the phase of the first signal CHX output from the encoder sensor 120 precedes the phase of the second signal CHY as shown in FIG. 4*a*, the direction decision unit 140 determines the travel direction of the carriage to be a forward direction.

If the phase of the second signal CHY output from the encoder sensor 120 precedes the phase of the first signal CHX as shown in FIG. 4*b*, the direction decision unit 140 determines the travel direction of the carriage to be a backward direction.

The edge detection unit 130 detects the rising edge and the falling edge of a signal input from the encoder sensor 120, and outputs an edge detection signal to the counter 150 and the controller 180.

The position counter 150 increases or decreases a certain counting value in relation to a direction decision signal input from the direction decision unit 140 and the edge detection signal input from the edge detection unit 130. For example, if the carriage moves in the forward direction, i.e., travels from left to right, the position counter 150 increases a predetermined initial counting value, and, if the carriage moves in the backward direction, i.e., travels from right to left, the position counter 150 decreases the counting value.

The comparator 170 compares a position value counted by the position counter 150 and a reference position value pre-stored in the storage unit 160. The comparator 170 outputs a "high" signal if the position value counted by the position counter 150 is equal to the reference position value, and outputs a "low" signal in case the position value is not equal to the reference position value. A signal resulting from the comparison of the comparator 170 is output to the control unit 180.

The control unit 180 determines that the carriage gets to a print start position if the "high" signal is received from the comparator 170. Further, the control unit 180 checks a signal output from the direction decision unit 140 and determines the travel direction of the carriage. If the carriage is determined to be at the predetermined reference position, the control unit 180 generates a fire A signal as a print reference signal based on a rising edge or a falling edge that is detected by the edge detection unit 130, and outputs the fire A signal to the printer head (not shown). It should be noted that the print reference signal denotes a signal having all the nozzles of the printer head fired.

Preferably, the print control apparatus 100 is further provided with a pulse generator (not shown) for generating a pulse corresponding to the print reference signal according to the controls of the control unit 180.

The control unit 180 controls the pulse generator to output the print reference signal based on the same edge detected by the edge detection unit 130 regardless of the travel direction of the carriage. Specifically, if the control unit 180 controls the pulse generator to output the print reference signal based on the rising edge of the first signal CHX detected by the edge detection unit 130 when the carriage moves in the forward direction, the control unit 180 controls the pulse generator to output the print reference signal based on the falling edge of the first signal CHX detected by the edge detection unit 130 when the carriage moves in the backward direction.

If the control unit 180 controls the pulse generator to output the print reference signal based on the falling edge of the first signal CHX detected by the edge detection unit 130 when the carriage moves in the forward direction, the control unit 180 controls the pulse generator to output the print reference signal based on the rising edge of the first signal CHX detected by the edge detection unit 130 when the carriage moves in the backward direction.

Figure 5:
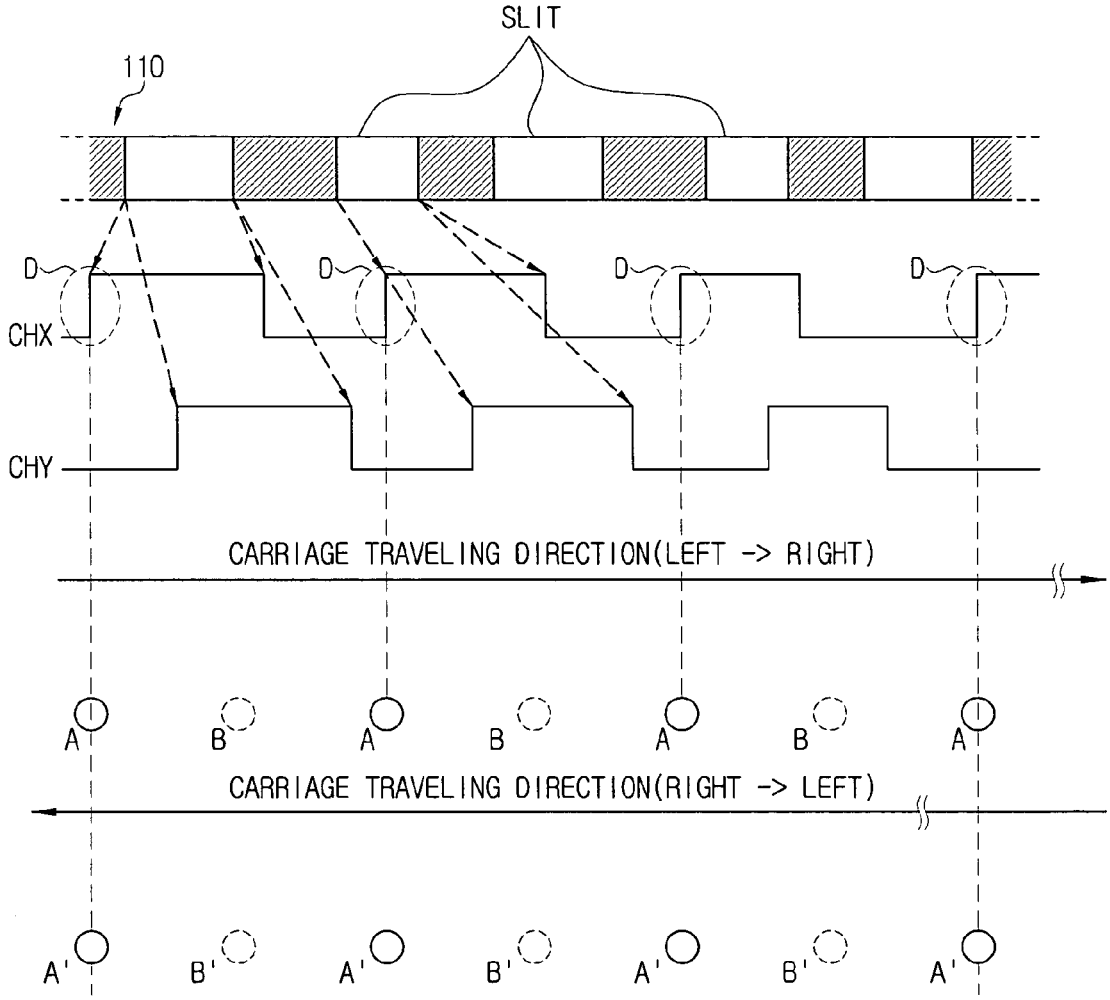
FIG. 5 is a diagram illustrating an example of print positions when the bi-directional print operations are performed using the print control apparatus shown in FIG. 3.

As mentioned above, if the print reference signal is output based on the same edge regardless of the travel direction of the carriage, the print start positions can be aligned as shown in FIG. 5.

In FIG. 5, a reference numeral A denotes print positions when a print job is performed with reference to the rising edge D of the first signal CHX detected by the edge detection unit 130 when the carriage moves in the forward direction, and a reference numeral A' denotes print positions when a print job is performed with reference to the falling edge D of the first signal CHX detected by the edge detection unit 130 when the carriage moves in the backward direction.

Since print jobs are performed with reference to the same edge D regardless of the travel direction of the carriage, the embodiment of the present invention can prevent print position errors from occurring due to the tolerance of the slits formed in the encoder strip 110.

Hereinafter, descriptions are made on a control method for a print control apparatus according to an embodiment of the present invention with reference to FIG. 6.

Figure 6:
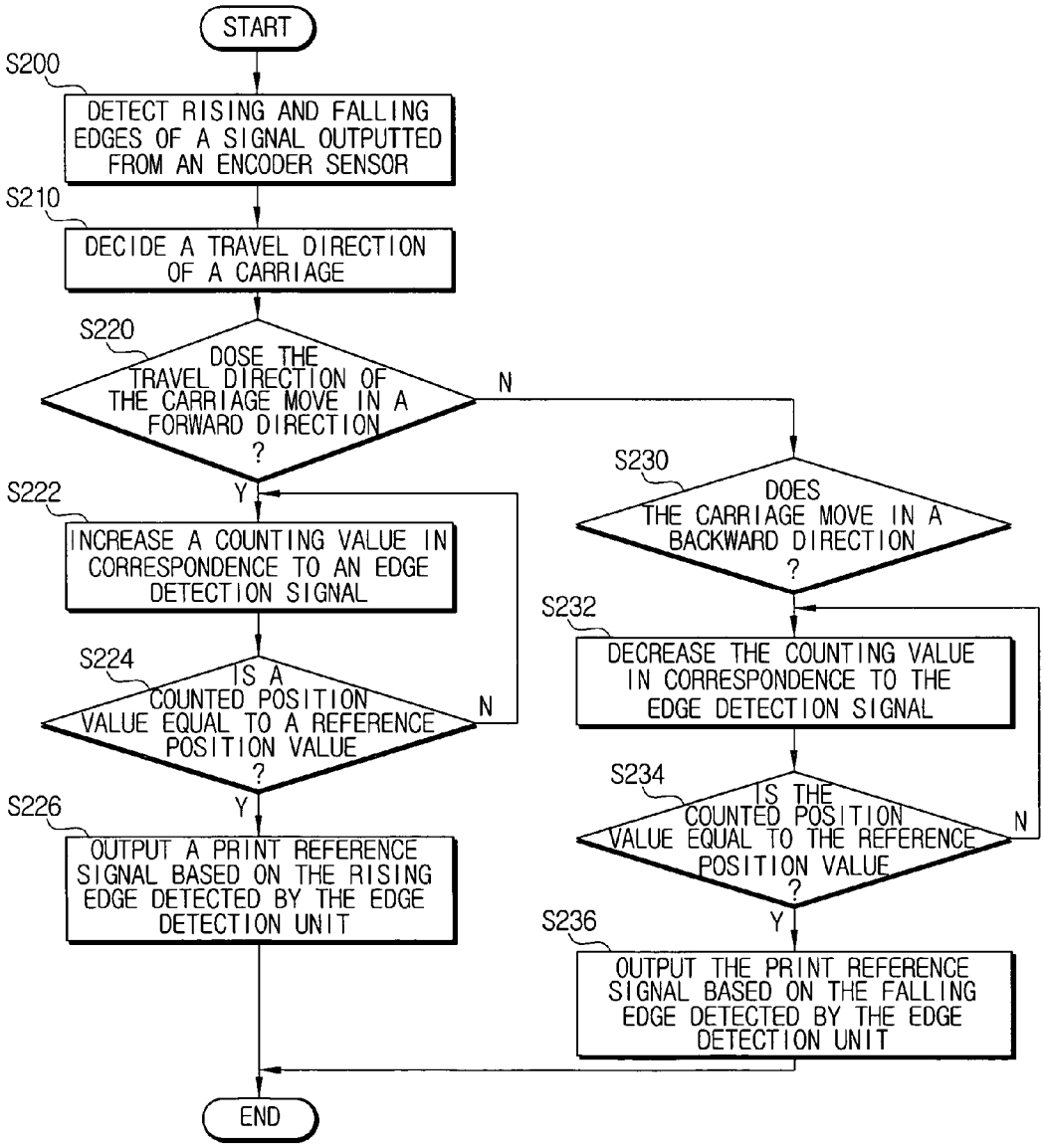
FIG. 6 is a flow chart illustrating an example of performing bi-directional print operations using the print control apparatus shown in FIG. 3.

FIG. 6 is a flow chart illustrating an example of performing bi-directional print operations using the print control apparatus shown in FIG. 3.

Referring to FIG. 6, the edge detection unit 130 detects the rising and falling edges of a signal output from the encoder sensor 120 at step S200. The direction decision unit 140 determines the travel direction of the carriage based on the two-phase signals CHX and CHY output from the encoder sensor 120 at step S210.

If the carriage is determined to move in the forward direction as a result of the decision of step S210 at step S220, the control unit 180 controls the position counter 150 to increase a counting value in relation to an edge detection signal input from the edge detection unit 130 at step S222. The position counter 150 outputs the increased counting value to the comparator 170 in relation to the edge detection signal. The comparator 170 compares the position value counted by the position counter 150 and the reference position value pre-stored in the reference value storage value 160.

If the position value counted by the position counter 150 is equal to the pre-stored reference position value as a result of the comparison step S224, the control unit 180 gets the carriage to a reference position, generates a print reference signal based on the rising edge detected by the edge detection unit 130, and outputs the print reference signal to the printer head at step S226. The printer head performs a print job according to the print reference signal applied from the control unit 180.

If the carriage is decided to move in the backward direction as a result of the decision of step S210 at step S230, the control unit 180 controls the position counter 150 to decrease the counting value in relation to the edge detection signal input from the edge detection unit 130 at step S232. The position counter 150 outputs the decreased counting value to the comparator 170 in relation to the edge detection signal. The comparator 170 compares the reference position value pre-stored in the reference value storage unit 160 with the position value counted by the position counter 150.

If it is determined that the position value counted by the position counter 150 is equal to the pre-stored reference position value as a result of the comparison of the comparator 170 at step S234, the control unit 180 gets the carriage to the reference position, generates the print reference signal based on the falling edge detected by the edge detection unit 130, and outputs the print reference signal to the printer head at step S236. The printer head performs the print job according to the print reference signal applied from the control unit 180.

The print control apparatus and method for inkjet printers according to the embodiment of the present invention can perform print jobs with reference to the same edge of a clock signal output from the encoder sensor upon bi-directional prints so as to prevent print position errors from occurring due to uneven intervals of the slits formed on the encoder strip, to thereby enhance print quality. Further, the embodiment of the present invention can provide the appropriate tolerance for slits as to the degree of precision required in manufacturing the encoder strip.

Although the embodiments of the present invention have been described, it will be understood by those skilled in the art that the embodiments of the present invention should not be limited to the described embodiments, but various changes and modifications can be made within the spirit and scope of the present invention as defined by the appended claims.

What is claimed is:

1. A print control apparatus for inkjet printers, comprising:

an encoder sensor for outputting a first and a second signal every time a slit is detected;

a direction decision unit for determining a travel direction of a carriage having a printer head therein based on the first and the second signal output from the encoder sensor;

an edge detection unit for detecting rising and falling edges of the first and second signals;

a position counter for increasing and decreasing a counting value in relation to a direction determination signal from the direction decision unit and an edge detection signal from the edge detection unit; and a control unit for moving the carriage to a predetermined reference position if the value counted by the position counter is equal to a predetermined reference position value, and outputting a print reference signal to the printer head, wherein the control unit outputs the print reference signal based on the same edge detected by the edge detection unit regardless of the travel direction of the carriage.

2. The print control apparatus as claimed in claim 1, further comprising:

a comparator for comparing the value counted by the position counter and the reference position value; and a pulse generator for generating a pulse corresponding to the print reference signal according to controls of the control unit.

3. The print control apparatus as claimed in claim 1, wherein the position counter increases the counting value if the carriage is determined to be traveling from the first position to the second position as a result of the decision of the direction decision unit, and decreases the counting value if the carriage is determined to be traveling from the second position to the first position.

4. The print control apparatus as claimed in claim 3, wherein, if the print reference signal is output based on the rising edge of the first signal detected by the edge detection unit when the carriage travels from the first position to the second position, the control unit controls the pulse generator to output the print reference signal based on the falling edge of the first signal when the carriage travels from the second position to the first position.

5. The print control apparatus as claimed in claim 3, wherein, if the print reference signal is output based on the falling edge of the first signal detected by the edge detection unit when the carriage travels from the first position to the second position, the control unit controls the pulse generator to output the print reference signal based on the rising edge of the first signal when the carriage travels from the second position to the first position.

6. The print control apparatus as claimed in claim 1, wherein the encoder sensor is disposed at a position corresponding to an encoder strip having plural slits spaced in a predetermined interval.

7. A control method for a print control apparatus, comprising steps of:

detecting rising and falling edges of first and second signals output from an encoder sensor every time a slit formed on an encoder strip is detected;

determining a travel direction of a carriage having a printer head therein based on the first and the second signal output from the encoder sensor;

increasing and decreasing a counting value based on an edge detection signal and a signal indicating a travel direction of the carriage;

comparing the counted value and a predetermined reference position value; and moving the carriage to a predetermined reference position if the counted value is equal to the predetermined reference position value, and outputting a print reference signal to the printer head, wherein the print reference signal is output based on the same edge detected by the edge detection step regardless of the travel direction of the carriage.

8. The control method as claimed in claim 7, wherein the counting step comprising steps of:

increasing the counting value if the carriage is determined to be traveling from a first position to a second position; and decreasing the counting value if the carriage is decided to travel from the second position to the first position.

9. The control method as claimed in claim 8, wherein, if the print reference signal is output based on the rising edge of the first signal detected by the edge detection step when the carriage travels from the first position to the second position, the print reference signal output step outputs the print reference signal based on the falling edge of the first signal when the carriage travels from the second position to the first position.

10. The control method as claimed in claim 8, wherein, if the print reference signal is output based on the falling edge of the first signal detected by the edge detection step when the carriage travels from the first position to the second position, the print reference signal output step outputs the print reference signal based on the rising edge of the first signal when the carriage travels from the second position to the first position.

* * * * *